US010051371B2

(12) United States Patent
Johnson, Jr.

(10) Patent No.: US 10,051,371 B2
(45) Date of Patent: Aug. 14, 2018

(54) HEADPHONE ON-HEAD DETECTION USING DIFFERENTIAL SIGNAL MEASUREMENT

(71) Applicant: Bose Corporation, Framingham, MA (US)

(72) Inventor: Edwin C. Johnson, Jr., Hopkinton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 14/231,524

(22) Filed: Mar. 31, 2014

(65) Prior Publication Data

US 2015/0281825 A1 Oct. 1, 2015

(51) Int. Cl.
*H04R 5/033* (2006.01)
*H04R 5/04* (2006.01)

(52) U.S. Cl.
CPC ..... *H04R 5/04* (2013.01); *H04R 5/033* (2013.01); *H04R 2430/03* (2013.01); *H04R 2460/03* (2013.01)

(58) Field of Classification Search
CPC ..... H04R 2460/03; H04R 2420/03; H04R 1/1008; H04R 1/1016; H03F 1/30
USPC ..... 381/74
See application file for complete search history.

(56) References Cited

U.S. PATENT DOCUMENTS 4,010,340 A 3/1977 Palmaer
4,955,729 A 9/1990 Marx
5,144,678 A 9/1992 Lenz
5,635,948 A 6/1997 Tonosaki
5,708,725 A 1/1998 Ito
6,118,878 A 9/2000 Jones
7,010,332 B1 3/2006 Irvin et al.
7,418,103 B2 8/2008 Sargaison
7,715,161 B2 5/2010 Grone
7,945,297 B2 5/2011 Philipp
8,098,838 B2 1/2012 Lee et al.
8,165,307 B2 4/2012 Wong et al.
8,165,308 B2 4/2012 Norhammar et al.
8,238,567 B2 8/2012 Burge et al.
8,238,570 B2 8/2012 Johnson, Jr. et al.
(Continued)

FOREIGN PATENT DOCUMENTS

CN 101340737 A 1/2009
CN 101951534 A 1/2011
(Continued)

OTHER PUBLICATIONS

International Search Report and Written Opinion of the International Searching Authority for International Application No. PCT/US2015/023279, dated Jul. 6, 2015, 10 pages.
(Continued)

*Primary Examiner* — George C Monikang
(74) *Attorney, Agent, or Firm* — Patterson + Sheridan, LLP

(57) ABSTRACT

A headset includes a first speaker coupled to a first compensation network and a second speaker coupled to a second compensation network. The headset also includes a differential sensing module configured to determine a differential signal between a first input signal associated with the first speaker and a second input signal associated with the second speaker. The differential signal is used to determine whether the headset is detected as worn by a user. A controller adjusts a power level supplied to the headset based on the differential signal.

20 Claims, 4 Drawing Sheets

(56) References Cited

U.S. PATENT DOCUMENTS

| | | | |
|---|---|---|---|
| 8,243,946 | B2 | 8/2012 | Burge et al. |
| 8,335,312 | B2 | 12/2012 | Gerhardt et al. |
| 8,489,026 | B2 | 7/2013 | Terlizzi |
| 8,498,439 | B2 | 7/2013 | Bae et al. |
| 8,600,085 | B2 | 12/2013 | Chen et al. |
| 8,630,425 | B2 | 1/2014 | Chang et al. |
| 8,699,719 | B2 | 4/2014 | Johnson, Jr. et al. |
| 2008/0031484 | A1 | 2/2008 | Danielson |
| 2010/0020982 | A1 | 1/2010 | Brown et al. |
| 2010/0246836 | A1 | 9/2010 | Johnson, Jr. et al. |
| 2011/0222701 | A1 | 9/2011 | Donaldson et al. |
| 2011/0235817 | A1 | 9/2011 | Lin |
| 2012/0086551 | A1 | 4/2012 | Lowe et al. |
| 2012/0244812 | A1 | 9/2012 | Rosener |
| 2013/0039507 | A1 | 2/2013 | Park et al. |
| 2013/0249849 | A1 | 9/2013 | Wong et al. |

FOREIGN PATENT DOCUMENTS

| | | | |
|---|---|---|---|
| EP | 0967592 | A2 | 12/1999 |
| EP | 2202998 | A1 | 6/2010 |
| GB | 2469796 | A | 11/2010 |
| WO | 2012134874 | A1 | 10/2012 |

OTHER PUBLICATIONS

EP Office Action for Application No. 15 716 653.9-1901 dated Oct. 24, 2017.

Notification of the First Office Action for Application No. CN2015800261752 dated Nov. 3, 2017.

HEADPHONE ON-HEAD DETECTION USING DIFFERENTIAL SIGNAL MEASUREMENT

I. FIELD OF THE DISCLOSURE

The present disclosure relates in general to a system for power control of a wearable audio device.

II. BACKGROUND

A user can wear a headset to enjoy music without distracting or bothering people around them. Noise canceling headsets allow a user to listen to audio, such as music, without hearing various noises that are not part of the audio. However, noise canceling headsets generally use additional power beyond what is used to provide a direct audio feed from an audio player to the headset. The additional power may be provided from a battery that is used to power the headset.

III. SUMMARY

Battery life for noise canceling headsets can be extended by reducing power provided to the headset when the noise canceling headset is detected as not worn by the user. In one implementation, a headset has a first speaker coupled to a first compensation network, a second speaker coupled to a second compensation network, and a differential sensing module configured to sense a differential signal between a first signal associated with the first speaker and a second signal associated with the second speaker. The differential signal is used to determine whether the headset is detected as worn by a user. The headset has a power source; a power level supplied to the first speaker and to the second speaker is adjusted based on whether the headset is detected as worn by the user based on the differential signal.

The first compensation network receives a first current and a first audio feed to provide a first output to the first speaker. The second compensation network receives a second current and a second audio feed to provide a second output to the second speaker. The first compensation network is coupled to a first feedback microphone which provides first feedback data to the first compensation network. The second compensation network is coupled to a second feedback microphone which provides second feedback data to the second compensation network.

The differential sensing module has a differential amplifier configured to receive the first signal at a first amplifier input, to receive the second signal at a second amplifier input, and to produce the differential signal. Examples of the first and second signals include first and second currents, first and second audio feeds, or first and second output signals from the first and second compensation networks. In a particular implementation, the differential amplifier is coupled to a band pass filter configured to filter the differential signal to produce a filtered waveform. The band pass filter is coupled to a level detector that is configured to detect a level of a magnitude of the filtered waveform. The level of the magnitude of the filtered waveform is used to determine if the headset is detected as worn by the user.

In another implementation, a method includes outputting audio to a headset having a first speaker and a second speaker, determining a differential signal at a differential sensing module, and determining whether the headset is detected as worn by a user based on the differential signal. The method further includes providing first feedback data from a first feedback microphone to a first compensation network and providing second feedback data from a second feedback microphone to a second compensation network. The method also includes adjusting a power level applied to the headset based on whether the headset is detected as worn by the user based on the differential signal. For example, the power level is reduced or turned off when the headset is detected as not worn by the user.

IV. BRIEF DESCRIPTION OF THE DRAWINGS

V. DETAILED DESCRIPTION

Figure 1:
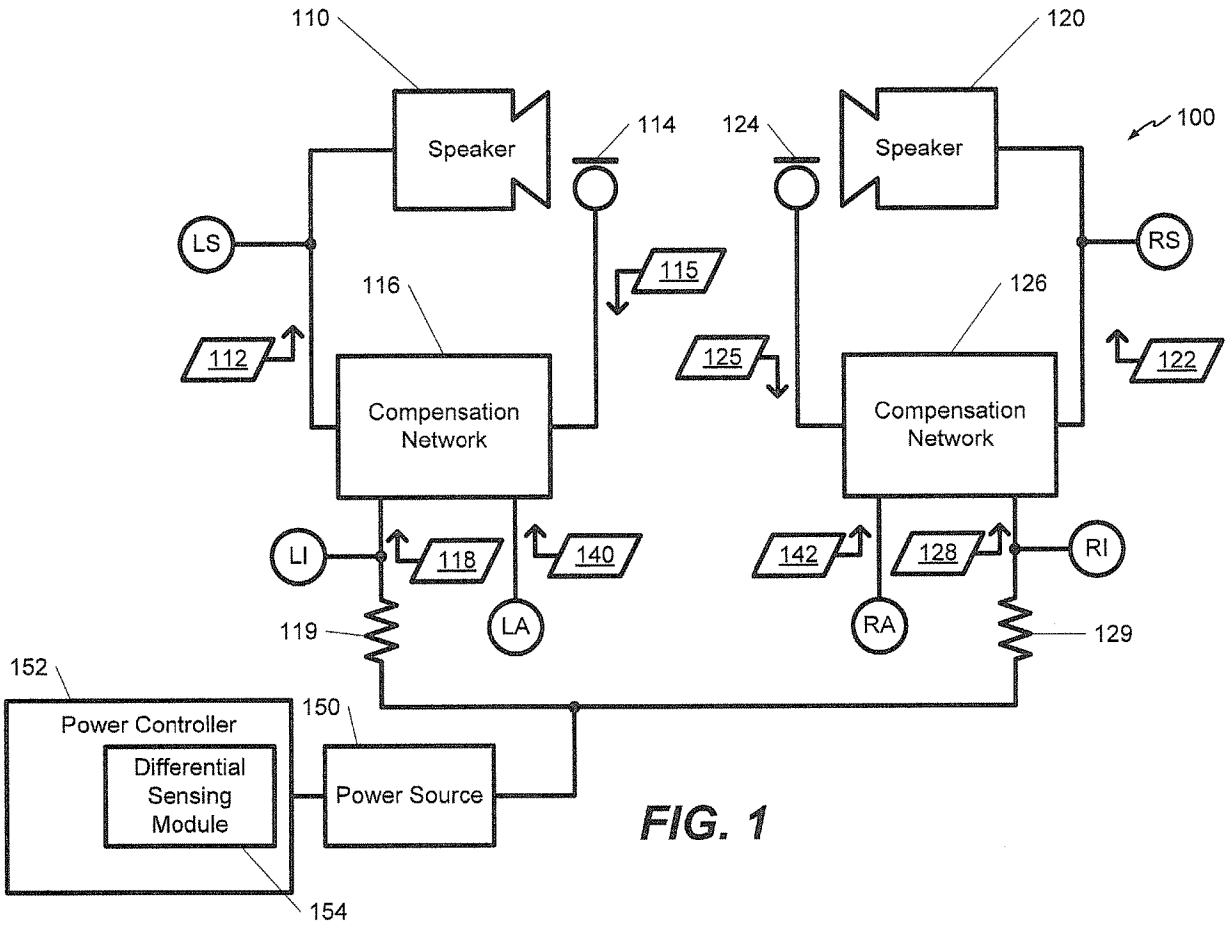
FIG. 1 is a diagram of an illustrative implementation of a headset.

FIG. 1 depicts a headset 100 having a first speaker 110 and a second speaker 120. The first speaker 110 and the second speaker 120 are configured to output sound corresponding to audio output signals provided by a first compensation network 116 and a second compensation network 126, respectively. The first compensation network 116 provides a first output signal 112 to the first speaker 110 based on a first audio feed 140, and the second compensation network 126 provides a second output signal 122 to the second speaker 120 based on a second audio feed 142.

A first feedback microphone 114 is coupled to the first compensation network 116 and provides first feedback data 115 to the first compensation network 116. The first feedback data 115 is used by the first compensation network 116 to adjust the first output signal 112 provided to the first speaker 110. For example, when the first feedback data 115 includes noise (e.g., ambient noise) detected by the first feedback microphone 114, the first compensation network 116 uses the first feedback data 115 to modify the first output signal 112 to compensate for the noise (e.g., subtracting a noise signal from a signal or adding an inverse of the noise signal to the signal at the first compensation network). The first compensation network 116 includes audio processing components, such as an amplifier driver, an equalizer, and a feedback compensation module. In an alternative implementation, a first feed-forward microphone provides first feed-forward data to the first compensation network 116 to further modify the first output signal 112.

Similarly, a second feedback microphone 124 is coupled to the second compensation network 126 and provides second feedback data 125 to the second compensation network 126 to form the second output signal 122. For example, when the second feedback data 125 includes noise (e.g., ambient noise) detected by the second feedback microphone 124, the second compensation network 126 uses the second feedback data 125 to modify the second output signal 122 to compensate for the noise. The second compensation network 126 includes audio processing components, such as an amplifier driver, an equalizer, and a feedback compensation module. In an alternative implementation, a second feed-forward microphone provides second feed-forward data to the second compensation network 126 to further modify the second output signal 122.

The first audio feed 140 is provided to the first compensation network 116 at a first audio input LA. The second audio feed 142 is provided to the second compensation network 126 at a second audio input RA. The first compensation network 116 processes the first audio feed 140 based at least on the first feedback data 115 to generate the first output signal 112. The first compensation network 116, the first speaker 110, and the first feedback microphone 114, in combination, form a first feedback loop. The second compensation network 126 processes the second audio feed 142 based at least on the second feedback data 125. The second compensation network 126 provides processed audio to the second speaker 120 via the second output signal 122. The second compensation network 126, the second speaker 120, and the second feedback microphone 124, in combination, form a second feedback loop.

When the headset 100 includes earcups, the first speaker 110, the second speaker 120, the first feedback microphone 114, and the second feedback microphone 124 are positioned within the earcups, and a sound pressure level within the earcups is measurable by the first feedback microphone 114 and the second feedback microphone 124. The first feedback microphone 114 and the second feedback microphone 124 preferably have, but are not limited to, a $dB_{SPL}$ range from approximately 25 $dB_{SPL}$ to approximately 125 $dB_{SPL}$. The sound pressure levels measured at the first feedback microphone 114 and the second feedback microphone 124 are included in the first feedback data 115 and the second feedback data 125, respectively. The first feedback data 115 and the second feedback data 125 allow the first compensation network 116 and the second compensation network 126 to adjust the first output signal 112 and the second output signal 122, respectively.

The headset 100 receives power from a power source 150. The power source 150 provides a first current 118, measurable at a first current node LI, via a first shunt resistor 119 (or other current sensing device) to the first compensation network 116. The power source 150 also provides a second current 128, measurable at a second current node RI, via a second shunt resistor 129 (or other current sensing device) to the second compensation network 126. Low frequencies (e.g., frequencies below 500 Hz) detected by the first feedback microphone 114 and the second feedback microphone 124 cause the first compensation network 116 and the second compensation network 126 to draw more power from the power source 150, thus increasing the first current 118 and the second current 128, respectively.

A power controller 152 is coupled to the power source 150. The power controller 152 includes a differential sensing module 154. The differential sensing module 154 is configured to receive input corresponding to the first current 118 and the second current 128, the first audio feed 140 and the second audio feed 142, the first output signal 112 and the second output signal 122, or any combination thereof. The differential sensing module 154 determines a differential signal based on the input. The power controller 152 is configured to cause the power source 150 to adjust a power level provided to the first compensation network 116 and to the second compensation network 126.

The power level is adjusted based on a comparison between the differential signal to a threshold. The power level is reduced to a standby state having low or no power provided to the first compensation network 116 and to the second compensation network 126 when the differential signal is below the threshold. The threshold is set so that when the headset is unworn by the user, the differential signal is below the threshold. The differential signal provides a better indication of whether the headset 100 is worn by the user than absolute signal values because variations in the ambient environment or the headset 100 result in similar effects on the first speaker 110 and the second speaker 120. The differential signal also provides a more robust and tolerant approach to features such as environmental processing because certain circumstances can affect both the first speaker 110 and the second speaker 120 in a similar manner.

The power controller 152 further includes a delay timer to prevent adjustment to the power level within a certain duration of time. For example, when the delay timer is set to five minutes, the power level is not reduced until the headset 100 is detected by the differential sensing module 154 as unworn for five minutes. The power controller 152 additionally includes elements illustrated in more detail in FIG. 2. Examples of implementations of the power controller 152 include, but are not limited to, a processor and memory module or circuitry, such as an application-specific integrated circuit (ASIC), a field-programmable gate array (FPGA), analog circuitry, or a combination thereof.

When the headset 100 is worn by the user, the differential signal has first characteristics. The first characteristics may correlate to a relatively large magnitude of the differential signal. For example, when the differential signal is a differential between the first current 118 and the second current 128, the first characteristics correspond to a differential between the left current node LI and the right current node RI that is greater than a current threshold. As another example, when the differential signal corresponds to a differential between the first output signal 112 and the second output signal 122, the first characteristics correspond to a differential between the left output driver LS and the right output driver RS that is greater than an output signal threshold. In an alternative implementation, the current threshold or the output signal threshold may be modified based on an audio feed differential between the first audio feed 140 and the second audio feed 142. For example, if the audio feed differential is high, then the current threshold or the output signal threshold would increase.

When the headset 100 is not worn by the user, the differential signal has second characteristics. For example, when the differential signal corresponds to a differential between the first current 118 and the second current 128, the second characteristics correspond to a differential between the left current node LI and the right current node RI that is less than the current threshold. As another example, when the differential signal corresponds to a differential between the first output signal 112 and the second output signal 122, the second characteristics correspond to a differential between the left output driver LS and the right output driver RS that is less than the output signal threshold. In an alternative implementation, the current threshold or the output signal threshold may be modified based on an audio feed differential between the first audio feed 140 and the second audio feed 142. For example, if the audio feed differential is high, then the current threshold or the output signal threshold would increase.

In operation, a first audio input LA and a second audio input RA receive the first audio feed 140 and the second audio feed 142, respectively, from an audio source, such as a digital audio player, a computer, a TV, or any other audio producing device. The first feedback microphone 114 provides the first feedback data 115 to the first compensation network 116. The first compensation network 116 generates the first output signal 112 based on signal sources including, but not limited to, the first audio feed 140 and the first feedback data 115 and sends the first output signal 112 to the first speaker 110. The second feedback microphone 124 provides the second feedback data 125 to the second compensation network 126. The second compensation network 126 generates the second output signal 122 based on signal sources including, but not limited to, the second audio feed 142 and the second feedback data 125 and sends the second output signal 122 to the second speaker 120. The differential sensing module 154 samples the first audio feed 140 and the second audio feed 142, the first output signal 112 and the second output signal 122, the first current 118 and the second current 128, or a combination thereof, and determines the differential signal.

Based on a comparison of the differential signal to a threshold (to determine whether the headset 100 is worn by the user), the power controller 152 causes the power source 150 to adjust the power level. For example, when the differential signal is less than a threshold, such as a small difference between the input signals to a differential sensing module 154, the power controller 152 determines that the headset 100 is not worn by the user and causes the power source 150 to reduce power provided to the headset 100 (e.g., by switching to a low-power standby state). The low-power standby state maintains power to the first feedback microphone 114 and to the second feedback microphone 124, as well as to some or all components of the first and the second compensation networks 116, 126. When in the low-power standby state, when the differential signal satisfies a second threshold, such as an increased difference between the inputs, the power controller 152 determines that the headset 100 is worn by the user and causes the power source 150 to increase power provided to the headset 100 (e.g., by switching to a higher power active state). In some implementations, the headset 100 makes a determination of whether the headset 100 is worn (based on a differential signal measurement) and generates data (e.g., a flag) indicating whether the headset is detected as worn or unworn. In other implementations, there is no explicit determination of whether the headset 100 is worn by the user. Rather, the power controller 152 outputs data indicating a relative measurement of the differential signal with regard to a threshold value. Power level adjustment provides a benefit of reducing power consumption when the headset 100 is determined as not worn by the user (based on a differential signal measurement) and extends battery life of the headset 100.

Figure 2:
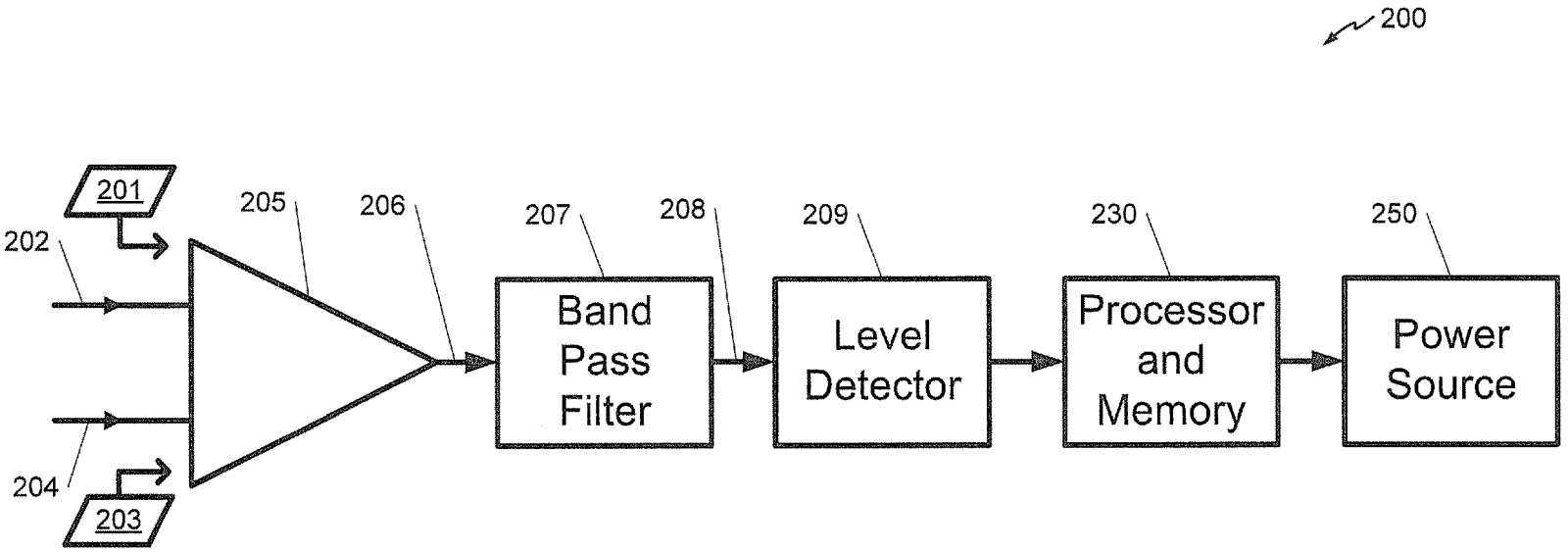
FIG. 2 is a block diagram of an illustrative implementation of a differential sensing module.

Regarding FIG. 2, a block diagram of a differential sensing module 200 is illustrated. The differential sensing module 200 has a differential amplifier 205 configured to receive a first input signal 201 from a first amplifier input 202 and a second input signal 203 from a second amplifier input 204. Examples of the first input signal 201 include the first current 118 (measured at the first current node LI), the first audio feed 140 (measured at the first audio input LA), the first output signal 112 (measured at the first output driver LS), or a combination thereof. Examples of the second input signal 203 include the second current 128 (measured at the second current node RI), the second audio feed 142 (measured at the second audio input RA), the second output signal 122 (measured at the second output driver RS), or a combination thereof. The differential amplifier 205 is configured to generate a differential signal 206 corresponding to a difference between the first input signal 201 and the second input signal 203. The differential amplifier 205 provides the differential signal 206 to a band pass filter 207.

The band pass filter 207 is configured to filter the differential signal 206. The differential signal 206, when unfiltered, contains extraneous data that is not directly related to a determination of whether the headset 100 is worn by the user. In cases where current differential is sensed, the band pass filter 207 is configured to remove differences in nominal current consumed by the first compensation network 116 and the second compensation network 126. Further, the band pass filter 207 is configured to reduce current differences resulting from detected signals that are unrelated to placement of the headset 100 on the head of the user. The band pass filter 207 filters the differential signal 206 to generate a filtered waveform 208. The filtered waveform 208 is provided to a level detector 209. The level detector 209 analyses the filtered waveform 208 to determine a magnitude of the filtered waveform 208 corresponding to an amount of differential between the first input signal 201 and the second input signal 203. The level detector 209 determines whether the magnitude of the filtered waveform 208 is above or below a threshold. The level detector 209 provides its output to the processor and memory module 230. Alternatively, the processor and memory module 230 may determine whether the magnitude of the filtered waveform 208 is above or below a threshold. When the difference between the first input signal 201 and the second input signal 203 is substantial (e.g., greater than a threshold), it is determined that the headset 100 is worn by the user. When the difference between the first input signal 201 and the second input signal 203 is not substantial (e.g., below a threshold), it is determined that the headset 100 is not worn by the user. Alternatively, the functions of the processor and memory module are implemented in an analog circuitry or an application-specific integrated circuit (ASIC).

The first compensation network 116 and the second compensation network 126 make audio adjustments (e.g., noise cancelation, speaker movement) to the first speaker 110 and the second speaker 120 based on the first feedback data 115 and the second feedback data 125, respectively. The first feedback data 115 and the second feedback data 125 include low frequency signals. Low frequencies sensed by the first feedback microphone 114 and the second feedback microphone 124 correspond to a large wavelength resulting in a magnitude and a phase that are approximately equal between the first speaker 110 and the second speaker 120 when the headset 100 is not worn by the user. Because the magnitude and the phase are approximately equal when the headset 100 is not worn by the user, pressure within the earcups sensed by the first feedback microphone 114 and the second feedback microphone 124 is also approximately equal resulting in the differential signal 206 being less substantial (e.g., below the threshold). Ambient pressure at low frequencies sensed by the first feedback microphone 114 and the second feedback microphone 124 in close proximity to the first speaker 110 and the second speaker 120 is larger when the headset 100 is worn by the user.

The first compensation network 116 and the second compensation network 126 use the first feedback data 115 and the second feedback data 125 to modify the first output signal 112 and the second output signal 122, respectively. Examples of modifications include, but are not limited to, adjusting a physical position of the first speaker 110 or the second speaker 120, increasing or decreasing volume of the first output signal 112 or the second output signal 122. For example, the physical position of the first speaker 110 relative to the user (e.g., closer or farther to the user's ear) affects the ambient pressure. In other examples, the first speaker 110 is oriented at an angle relative to the user's ear, so the first speaker 110 is not facing the user's ear. These modifications indirectly create the differential signal 206 by having different modifications applied to the first output signal 112 and the second output signal 122.

When the headset 100 is worn, various imperfections tend to create differences between a seal of the first speaker 110 and a seal of the second speaker 120. Examples of imperfections include, but are not limited to, asymmetry in a shape of the user's head, a difference in seals of the earcups, a difference in movement of the user's head (e.g., chewing or talking), a difference in time of arrival of a heartbeat-related blood pressure pulse, opposite polarity of pressure change associated with movement of the user's head. The differences affect the sound pressure level causing a measurable difference between the first output signal 112 and the second output signal 122 when the headset 100 is worn by the user. Additionally, the first feedback microphone 114 and the second feedback microphone 124 detect different signals resulting from minor head movements, talking, chewing, walking, etc. The user's heartbeat is also sensed at low frequencies, even when the user is relatively motionless, allowing the first feedback microphone 114 and the second feedback microphone 124 to detect differences between the first speaker 110 and the second speaker 120. These differences affect the first output signal 112 and the second output signal 122. For example, the first compensation network 116 adjusts the first output signal 112 differently than the second compensation network 126 adjusts the second output signal 122 to improve audio quality with respect to different sound pressure levels with regard to the first speaker 110 and the second speaker 120. The differential signal 206 reflects these differences and is used to determine whether the headset 100 is worn by the user (e.g., the differential signal is above a threshold).

When the processor and memory module 230 determines whether the headset 100 is worn by the user based on levels of the filtered waveform 208, the processor and memory module 230 is configured to cause the power source 250 to adjust the power level provided to the headset 100. In other implementations, the processor and memory module 230 is configured to delay adjustment of the power level to prevent inaccurate or momentary adjustments of the power level. For example, when the delay time is five minutes, the headset 100 must be detected as unworn for five minutes before the power level is reduced. Examples of implementations of the processor and memory module 230 include, but are not limited to, an application-specific integrated circuit (ASIC), a field-programmable gate array (FPGA), analog circuitry, a general purpose processor, or a combination thereof configured to execute instructions from a memory device.

Figure 3:
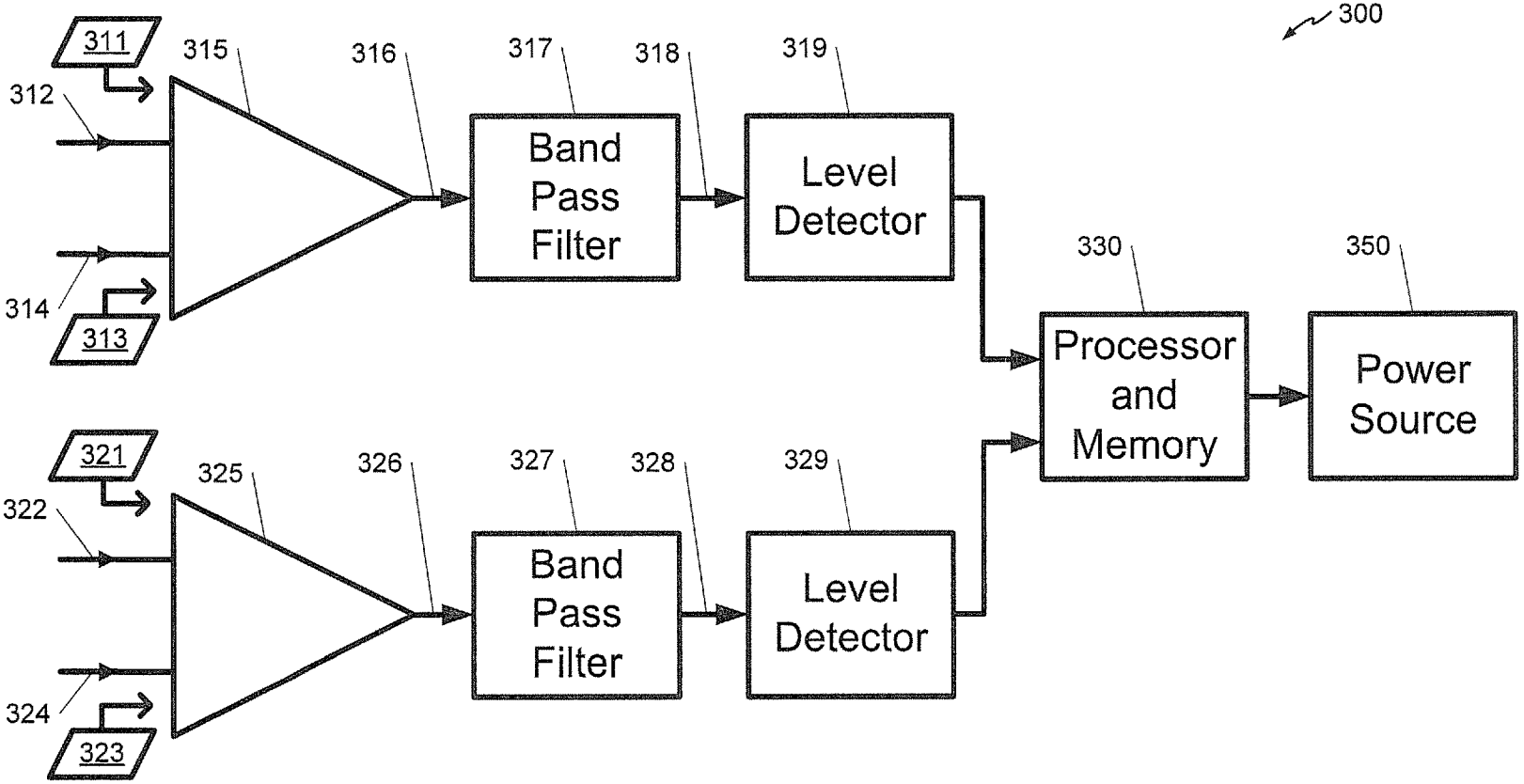
FIG. 3 is a block diagram of an illustrative implementation of a differential sensing module having two sets of differential inputs.

FIG. 3 illustrates a block diagram of an alternative implementation of a differential sensing module 300. The differential sensing module 300 allows for multiple inputs to a processor and memory module 330. The differential sensing module 300 has a first differential amplifier 315 configured to accept a first input signal 311 at a first amplifier input 312 and a second input signal 313 at a second amplifier input 314. The differential sensing module 300 also has a second differential amplifier 325 configured to accept a third input signal 321 at a third amplifier input 322 and a fourth input signal 323 at a fourth amplifier input 324. The first differential amplifier 315 is configured to generate a first differential signal 316 corresponding to a difference between the first input signal 311 and the second input signal 313. The first differential amplifier 315 provides the first differential signal 316 to a first band pass filter 317. The second differential amplifier 325 is configured to generate a second differential signal 326 corresponding to a difference between the third input signal 321 and the fourth input signal 323. The second differential amplifier 325 provides a second differential signal 326 to a second band pass filter 327.

The first band pass filter 317 is configured to filter the first differential signal 316 to produce a first filtered waveform 318, and the second band pass filter 327 is configured to filter the second differential signal 326 to produce a second filtered waveform 328. The first band pass filter 317 provides the first filtered waveform 318 to a first level detector 319 for level analysis, and the second band pass filter 327 provides the second filtered waveform 328 to a second level detector 329 for level analysis. The first level detector 319 and the second level detector 329 provide information indicating levels associated with respective filtered waveforms (e.g., a magnitude of a differential between the respective input signals) to the processor and memory module 330. The processor and memory module 330 is configured to make a determination as to whether to cause the power source 350 to adjust the power level provided to the headset 100 based on the information provided by the first level detector 319 and the second level detector 329 (e.g., whether the magnitude is above a threshold). Examples of implementations of the processor and memory module 330 include, but are not limited to, an application-specific integrated circuit (ASIC), a field-programmable gate array (FPGA), analog circuitry, a general purpose processor, or a combination thereof configured to execute instructions.

The first input signal 311 and the second input signal 313 are not restricted to one signal type, but when determining the first differential signal 316, the first input signal 311 and the second input signal 313 are the same signal type. The first differential amplifier 315 and the second differential amplifier 325 receive different signal types. For example, when the first input signal 311 and the second input signal 313 are of one particular signal type, the third input signal 321 and the fourth input signal 323 are of another particular signal type. In one example implementation, the first input signal 311 and the second input signal 313 receive input from the first current 118 and the second current 128, respectively, and the third input signal 321 and the fourth input signal 323 receive input from the first audio feed 140 and the second audio feed 142, respectively. In another example implementation, the first input signal 311 and the second input signal 313 receive input from a first speaker drive and a second speaker drive. The processor and memory module 330 is configured to make its determination based on one or both of the first differential signal 316 and the second differential signal 326. In one example implementation, the processor and memory module 330 uses both current and output signals in combination to determine if the headset 100 is worn by the user. For example, the processor and memory module 330 is configured to compare both current and output signals to their respective thresholds and determine if one or both satisfy their respective thresholds. In yet another example implementation, the processor and memory module 330 uses both output signals and audio feeds and determines based on only output signals whether the headset 100 is worn by the user. For example, only output signals are compared against its respective threshold. Although only two differential amplifiers 315 and 325 are shown, other implementations include more than two differential amplifiers allowing the processor and memory module 330 to make its determination based on any combination of multiple differential signals.

In one example implementation, the processor and memory module 330 determines that the headset 100 is worn by the user when a majority of the multiple differential signals (e.g., two out of three differential signals) are greater than their respective thresholds. In another example implementation, the first differential signal 316 is an audio feed differential, and the second differential signal 326 is an output signal differential. An output signal threshold is increased based on the audio feed differential because the audio feed differential propagates through to the output signal differential. Thus, the second differential signal satisfying a threshold is based on characteristics of the first differential signal.

Figure 4:
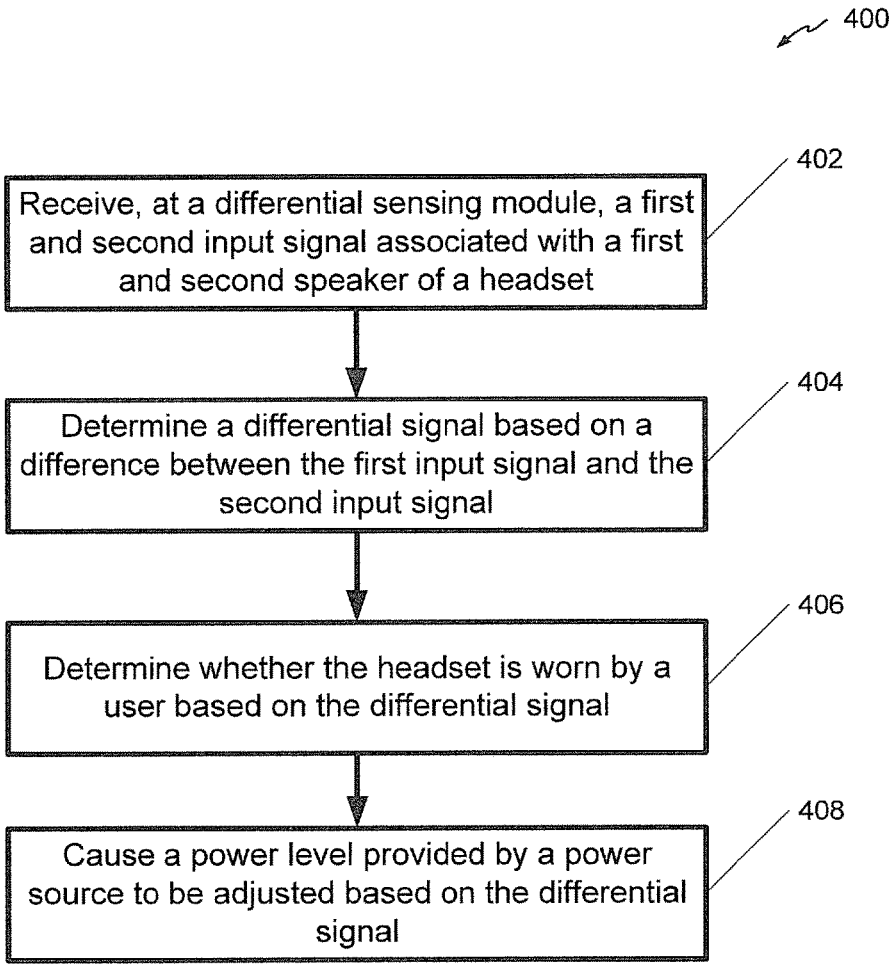
FIG. 4 is a flowchart of an illustrative implementation of a method for adjusting a power level of a headset.

FIG. 4 depicts a flowchart diagram representing an example implementation of a method 400 for adjusting a power level of a headset. In a particular example, the headset is the headset 100. The method 400 includes, at 402, receiving, at a differential sensing module, a first input signal associated with a first speaker and a second input signal associated with a second speaker of a headset. For example, the first input signal can be the first output signal 112, the first feedback data 115, the first current 118, the first audio feed 140, or a combination thereof, and the second signal can be the second output signal 122, the second feedback data 125, the second current 128, the second audio feed 142, or a combination thereof. In an example implementation, the differential sensing module includes the differential amplifier 205, the band pass filter 207, the level detector 209, and the processor and memory module 230 of FIG. 2. In another example implementation, the differential sensing module includes the first differential amplifier 315, the second differential amplifier 325, the first band pass filter 317, the second band pass filter 327, the first level detector 319, the second level detector 329, and the processor and memory module 330 of FIG. 3.

The method 400 includes determining a differential signal based on a difference between the first input signal and the second input signal, at 404. In an example implementation, determining a differential signal occurs at the differential amplifier 205 of FIG. 2. In another implementation, determining a differential signal occurs at the first differential amplifier 315 and the second differential amplifier 325.

The method 400 also includes determining whether the headset is detected as worn by a user based on the differential signal, at 406. In an example implementation, determining whether the headset is detected as worn occurs at the processor and memory module 230 of FIG. 2. In another example implementation, determining whether the headset is detected as worn occurs at the processor and memory module 330 of FIG. 3.

The method 400 further includes causing a power level provided by a power source to be adjusted based on the differential signal, at 408. For example, the power controller 152, responsive to determining whether the headset is detected as worn by a user, causes the power source 150 to reduce the power level provided to the first compensation network 116 and the second compensation network 126 as in FIG. 1. In some implementations, a delay timer is included to prevent adjusting the power level until expiration of a certain time period, at 408. The delay timer allows the headset to remain at a particular power level during a short time when the headset is detected as not worn by a user, such as when a user briefly removes the headset to engage in a short conversation.

Those skilled in the art may make numerous uses and modifications of and departures from the specific apparatus and techniques disclosed herein without departing from the inventive concepts. For example, selected implementations of headsets in accordance with the present disclosure may include all, fewer, or different components than those described with reference to one or more of the preceding figures. The disclosed implementations should be construed as embracing each and every novel feature and novel combination of features present in or possessed by the apparatus and techniques disclosed herein and limited only by the scope of the appended claims, and equivalents thereof.

The invention claimed is:

1. A headset comprising:

a first earpiece associated with an ear of a wearer, the first earpiece comprising a first speaker;

a second earpiece associated with the other ear of the wearer, the second earpiece comprising a second speaker;

a first input signal provided to the first earpiece, the first input signal comprising at least one of: a first current from a power source, a first audio feed from an audio player, and a first output signal from a compensation network;

a second input signal provided to the second earpiece, the second input signal comprising at least one of: a second current from the power source, a second audio feed from the audio player, and a second output signal from the compensation network;

a differential sensing module including a differential amplifier, the differential sensing module configured to determine a differential signal between the first signal and the second signal, wherein the first and second signals are provided without mixing to the differential amplifier; and a power source to adjust a power level provided to the first speaker and the second speaker based on the differential signal.

2. The headset of claim 1, wherein the differential sensing module comprises:

a differential amplifier configured to receive a first signal at a first amplifier input, to receive a second signal at a second amplifier input, and to produce the differential signal based on a difference between the first signal and the second signal, wherein the first signal and the second signal;

a band pass filter coupled to the differential amplifier, wherein the band pass filter is configured to filter the differential signal to produce a filtered waveform; and a level detector coupled to the band pass filter, wherein the level detector is configured to determine whether a magnitude of the filtered waveform satisfies a threshold.

3. The headset of claim 2, wherein the magnitude of the filtered waveform satisfies the threshold when the first speaker and the second speaker are worn by a user.

4. The headset of claim 2, wherein the power source is configured to decrease the power level in response to a determination that the magnitude of the filtered waveform does not satisfy the threshold.

5. The headset of claim 2, wherein the power source is configured to increase the power level in response to a determination that the magnitude of the filtered waveform satisfies the threshold.

6. The headset of claim 1, further comprising:

a first compensation network coupled to the first speaker and configured to:

receive the first current and the first audio feed; and provide the first output signal to the first speaker; and a second compensation network coupled to the second speaker and configured to:

receive the second current and the second audio feed; and provide the second output signal to the second speaker, wherein the first audio feed and the second audio feed are from an audio source, and wherein the audio source is distinct from a feedback microphone positioned within the first earpiece.

7. The headset of claim 6, further comprising:

a first feedback microphone coupled to the first compensation network, wherein the first feedback microphone is configured to provide first feedback data to the first compensation network, the first output signal generated based on the first audio feed and the first feedback data; and a second feedback microphone coupled to the second compensation network, wherein the second feedback microphone provides second feedback data to the second compensation network, and wherein the second output signal is generated based on the second audio feed and the second feedback data.

8. The headset of claim 6, wherein the differential sensing module is further configured to sample the first and second audio feeds, the first and second output signals, and the first and second currents prior to a determination of the differential signal.

9. The headset of claim 6, wherein the first signal is the first audio feed provided to the first compensation network and the second signal is the second audio feed provided to the second compensation network.

10. A method comprising:

receiving, at a differential sensing module, a first signal associated with a first earpiece and an ear of a wearer, the first earpiece comprising a first speaker;

receiving, at the differential sensing module, a second signal associated with a second earpiece and the other ear of the wearer, the second earpiece comprising a second speaker, wherein the first and second signals are unmixed prior to receipt at the differential sensing module;

receiving a first input signal provided at the first earpiece, the first input signal comprising at least one of: a first current from a power source, a first audio feed from an audio player, and a first output signal from a compensation network;

receiving a second input signal at the second earpiece, the second input signal comprising at least one of: a second current from the power source, a second audio feed from the audio player, and a second output signal from the compensation network;

determining a differential signal based on a difference between the first signal and the second signal; and adjusting a power level provided by a power source to a headset based on the differential signal.

11. The method of claim 10, further comprising:

performing a comparison of the differential signal to a threshold; and determining, at a controller, whether the headset is detected as worn by a user based on the comparison of the differential signal to the threshold.

12. The method of claim 11, further comprising when the headset is determined to be not worn by the user, reducing the power level to a standby state.

13. The method of claim 11, further comprising when the headset is determined to be worn by the user, adjusting the power level to an active state.

14. The method of claim 10, further comprising receiving, at the first speaker, the first output signal, wherein the first output signal is based on the first audio feed and first feedback data, and wherein the first feedback data is provided by a first feedback microphone to the first compensation network; and receiving, at the second speaker, the second output signal, wherein the second output signal is based on the second audio feed and second feedback data, and wherein the second feedback data is provided by a second feedback microphone to the second compensation network.

15. The method of claim 10, further comprising delaying adjustment of the power level for a particular duration of time.

16. A headset comprising:

a first earpiece associated with an ear of a wearer, the first earpiece comprising a first speaker, wherein the first earpiece receives a first input signal comprising at least one of: a first current, a first audio feed from an audio player, and a first output signal from a compensation network;

a second earpiece associated with the other ear of the wearer, the second earpiece comprising a second speaker, wherein the second earpiece receives second input signal comprising at least one of: a second current, a second audio feed from an audio player, and a second output signal from a compensation network;

a differential amplifier configured to:

receive, at a first amplifier input, a first signal associated with the first speaker;

receive, at a second amplifier input, a second signal associated with the second speaker, wherein the first signal and second signals are unmixed prior to receipt at the differential sensing amplifier; and produce a differential signal based on a difference between the first signal and the second signal;

a band pass filter coupled to the differential amplifier, wherein the band pass filter is configured to filter the differential signal to produce a filtered waveform;

a level detector coupled to the band pass filter, wherein the level detector is configured to determine whether a magnitude of the filtered waveform satisfies a threshold; and a power source configured to adjust a power level provided to the first speaker and to the second speaker based on the a determination of whether the magnitude of the filtered waveform satisfies the threshold.

17. The headset of claim 16, further comprising:

a first compensation network coupled to the first speaker and configured to:

receive a first current from a power source and a first audio feed from an audio source, wherein the audio source is distinct from a feedback microphone positioned within an earcup; and provide a first output signal to the first speaker; and a second compensation network coupled to the second speaker and configured to:

receive a second current from the power source and a second audio feed from the audio source; and provide a second output signal to the second speaker.

18. The headset of claim 17, wherein the first compensation network is further coupled to a first feedback microphone, the first feedback microphone is configured to provide first feedback data to the first compensation network, and wherein the second compensation network is further coupled to a second feedback microphone, the second feedback microphone is configured to provide second feedback data to the second compensation network.

19. The headset of claim 17, wherein the differential amplifier is further configured to sample the first and second audio feeds, the first and second output signals, and the first and second currents prior to a determination of the differential signal.

20. The headset of claim 16, wherein the power source is further configured to:

upon a determination that the magnitude of the filtered waveform does not satisfy the threshold, use a low power state or a standby state; and upon a determination that the magnitude of the filtered waveform satisfies the threshold, use an active state.

* * * * *